United States Patent [19]

Bjornstad

[11] 4,429,486

[45] Feb. 7, 1984

[54] CONSTRUCTION AND METHOD FOR MODELS WITH INTERLOCKING TAB/SLOT ASSEMBLY

[75] Inventor: Arne Bjornstad, Vagsbygd, Norway

[73] Assignee: Minilife A/S, Kristiansand, Norway

[21] Appl. No.: 447,011

[22] Filed: Dec. 6, 1982

Related U.S. Application Data

[63] Continuation of Ser. No. 305,325, Sep. 24, 1981.

[51] Int. Cl.[3] ..... A63H 33/16

[52] U.S. Cl. ..... 46/21; 229/45 R; 493/390; 493/959

[58] Field of Search ..... 46/11, 18, 19, 21, 30, 46/31, 35, 1 K; 229/45; 493/137, 390, 959

[56] References Cited

U.S. PATENT DOCUMENTS

| | | | |
|---|---|---|---|
| 1,258,086 | 3/1918 | Bennett | 46/21 |
| 2,102,497 | 12/1937 | Trogman | 229/45 X |
| 2,104,628 | 1/1938 | Warren | 46/21 |
| 2,112,474 | 3/1938 | Warren | 46/21 |
| 2,120,470 | 6/1938 | Patterson | 229/45 X |
| 2,204,264 | 6/1940 | Warren | 46/21 |
| 2,268,906 | 1/1942 | Scheer | 229/45 X |
| 2,331,754 | 10/1943 | Wohlers | 229/45 X |
| 2,556,323 | 6/1951 | Feigelman | 46/21 |
| 3,666,607 | 5/1972 | Weissman | 493/390 X |

FOREIGN PATENT DOCUMENTS

| | | | |
|---|---|---|---|
| 998656 | 9/1951 | France | 46/18 |

*Primary Examiner*—F. Barry Shay

*Attorney, Agent, or Firm*—Cooper, Dunham, Clark, Griffin & Moran

[57] ABSTRACT

A construction set for model houses and other enclosures formed of cooperating components of cardboard or similar material is disclosed wherein a combination of cooperating tabs and slots that interlock are provided on the components to produce simple and secure assembly. Two or more adjacent walls, having foldable tongues and rigid projections on one common edge, may be constructed from a single flat sheet member which can be appropriately folded and attached to a perpendicularly disposed floor member, having appropriate cooperating foldable tabs and slots, to form part or all of an enclosure. Adjacent disconnected wall members may be joined by means of an extension tab on the mating edge of one member, having a slot therein near its root, and a cooperating slot in the mating wall of the other member for accommodating the passage of the extension tab and its slot. A separate locking tongue piece is provided for insertion in the tab slot to fasten the mating edge to the slotted wall. A further fastening arrangement, in the form of a foldable tongue on the edge of one wall and parallel slots in an adjacent wall is also disclosed.

20 Claims, 6 Drawing Figures

Fig. 3.
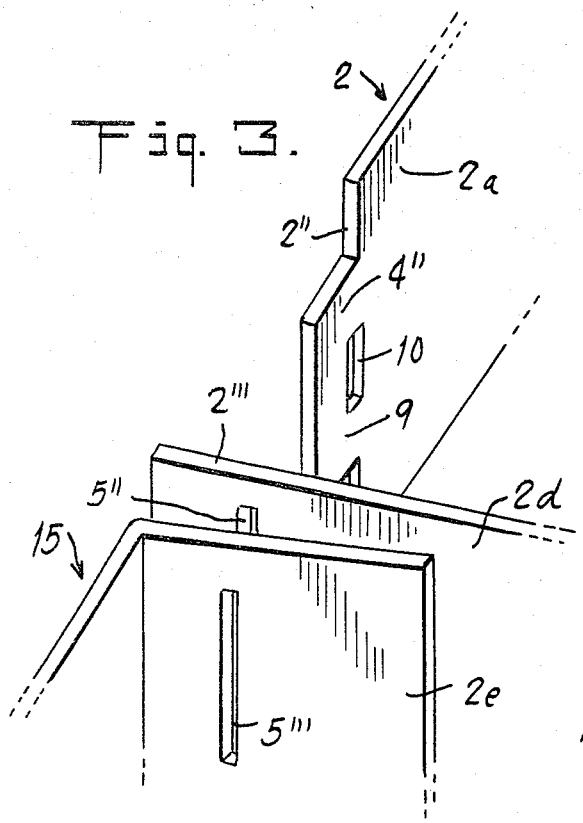
Fig. 4.
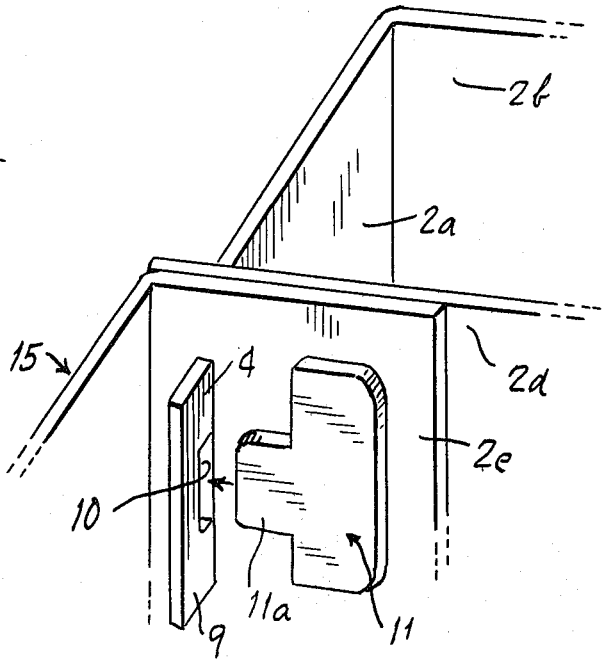
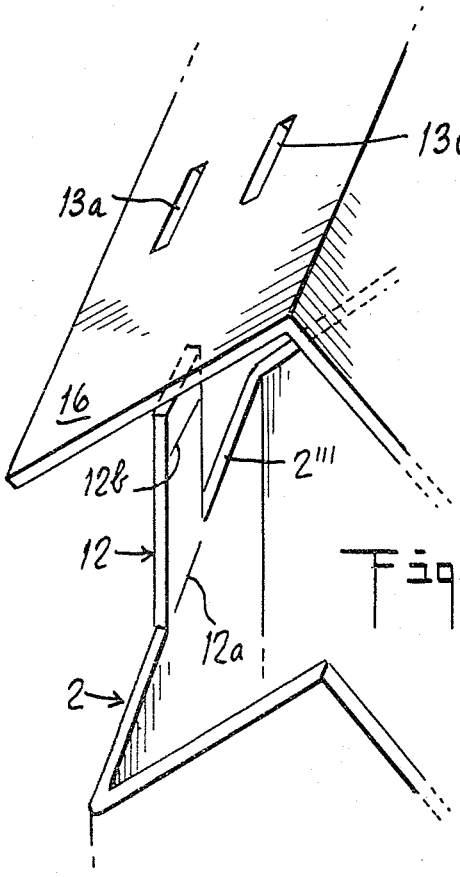
Fig. 5.
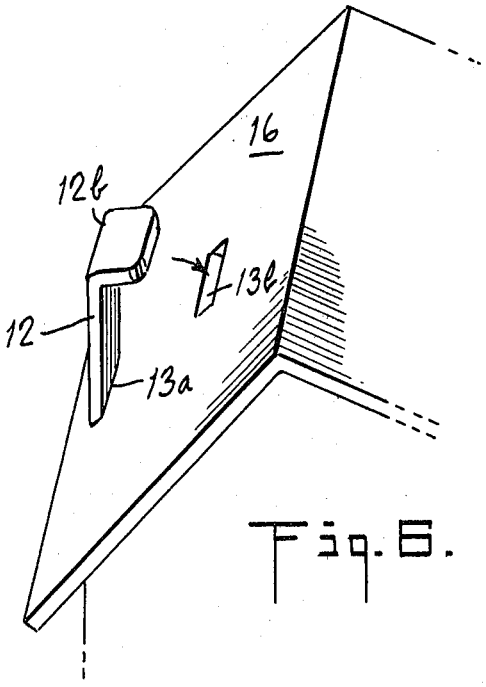
Fig. 6.

CONSTRUCTION AND METHOD FOR MODELS WITH INTERLOCKING TAB/SLOT ASSEMBLY

This is a continuation of application Ser. No. 305,325, filed Sept. 24, 1981.

BACKGROUND OF THE INVENTION

The present invention relates to toy or model structures assembled from printed blanks of foldable material such as cardboard, and particularly to a method and means for attaching the structure walls and other members together in a simple, neat, and secure fashion.

Many and various forms of interlocking tab and slot assembly systems are known for assembling toy and model structures from sheet materials such as cardboard and paper-board, for example, as disclosed in U.S. Pat. Nos. 1,984,666, 2,104,628, 2,112,474 and 2,204,264 to Warren, as well as U.S. Pat. No. 2,232,953 to Mallgraf and U.S. Pat. No. 2,556,323 to Feigelman. However, it will be seen that in most prior arrangements of this type portions of the attaching or connecting means protrude externally of the structure formed in a manner differing from the actual structure being modeled.

The present invention provides an improved tab and slot assembly arrangement with cooperating components that can be readily manipulated to produce a simple, neat, and secure construction.

SUMMARY OF THE INVENTION

The present invention embodies a construction set for building toy or model structures such as houses and other enclosures using components formed from printed blanks of foldable material, such as cardboard, and particularly involves means in the form of cooperating tabs, slots and tongues on the components and a method for connecting them together to produce neat, secure structures of any desired complexity of design. In particular, mating components, such as cooperating wall and floor members are provided with at least two fold-up tabs having slots therethrough at their roots and at least one slot adjacent one of the tabs on the floor member and with at least two foldable tongues and a projection near one of the tongues on the lower edge of the wall member. The tongue near the projection is insertable into the fold-up tab slot adjacent the one slot into which latter slot the projection is inserted so that the tongue is bent at a right angle with respect to the projection. The wall member is then folded into two or more wall portions and the other tongue on one of the wall portions is folded and inserted into the other fold-up tab slot, thus holding the folded wall member substantially perpendicularly on the floor member. Abutting wall components are held together by providing an extension tab on the abutting edge of one wall with a locking slot near its root, and providing a complimentary slot in the abutting wall for receiving the tongue extension tab, and then locking the abutting walls together by inserting a separate locking tongue in the locking slot, after the extension tab and complimentary slot have been brought into mutual engagement. A roof member may be attached to the top of a wall by providing a foldable tongue on the wall and two parallel slots in the roof member, and inserting the tongue through one of the slots folding it onto the roof member and passing its folded end into the other slot.

The various tab, slot, and tongue arrangements can be used cooperatively on different components to create neat and securely formed structures, containing myriad architectural features, from printed blanks of thin foldable cardboard.

BRIEF DESCRIPTION OF THE DRAWINGS

FIG. 3 is a perspective view illustrating the first step in assembling abutting wall members in constructing a toy house in accordance with the present invention.

FIG. 4 is a perspective view as in FIG. 3 illustrating a further step in assembling the abutting wall members.

FIG. 5 is a perspective view illustrating the first step in assembling roof and wall members in accordance with the present invention.

FIG. 6 is a perspective view as in FIG. 5 illustrating a further step in the wall and roof member assembly.

DETAILED DESCRIPTION OF THE INVENTION

Figure 1:
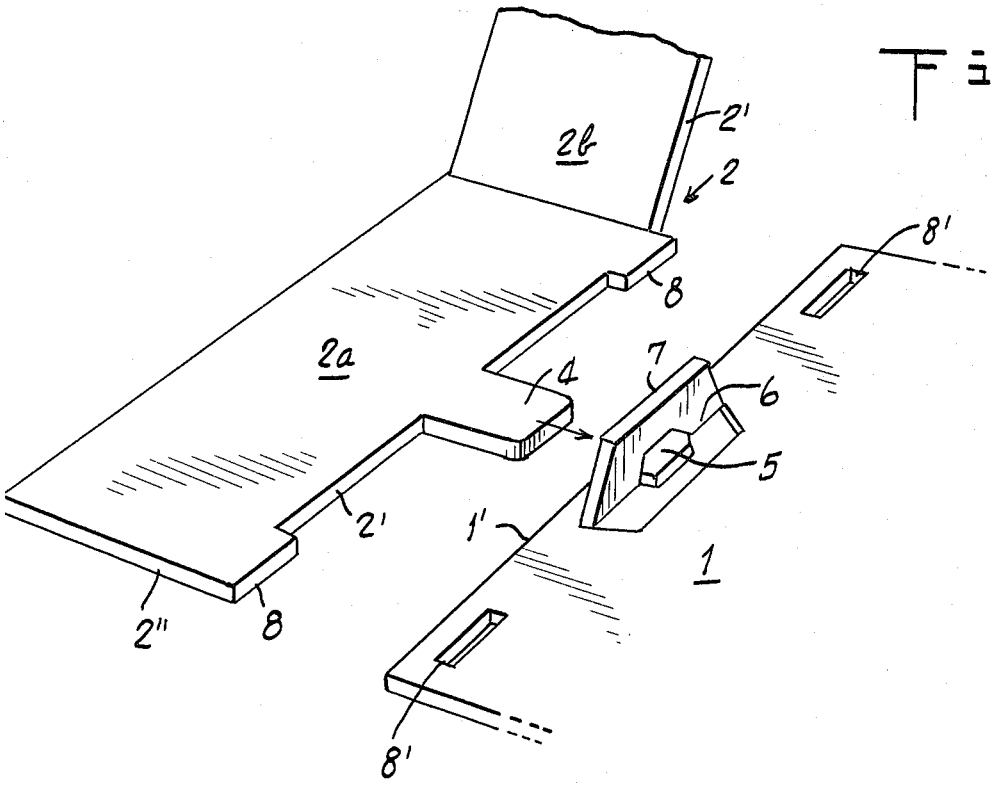
FIG. 1 is a perspective view illustrating the first step in assembling two construction components into accordance with the present invention into floor and wall members for a toy house.

FIG. 1 shows cooperating parts of two structural components of thin foldable material such as cardboard, paper-board, plastic or other like sheet material which may be found suitable for the described purpose. The two components, which may be printed or otherwise marked with pictures or forms resembling or imitating known structures in miniature, are provided with cooperating elements thereon for connecting them together in accordance with the present invention. In particular, one component 1, which for convenience of description shall be referred to as the floor member, is a flat sheet having attached to its surface, or preferably cut in the material thereof, a fold-up tab 7 with a slot 5 passing through it near its root 6. The tab 7, as shown, has its root 6 arranged parallel and adjacent to the marginal edge 1' of member 1, but it may be provided at other locations, and in other orientations, on the surface of the member. At least one slot, and preferably two slots 8', are formed in the floor member 1 on either side, in alignment with and spaced somewhat from, the tab 7. The slots 8' preferably pass through the entire thickness of the member.

Figure 2:
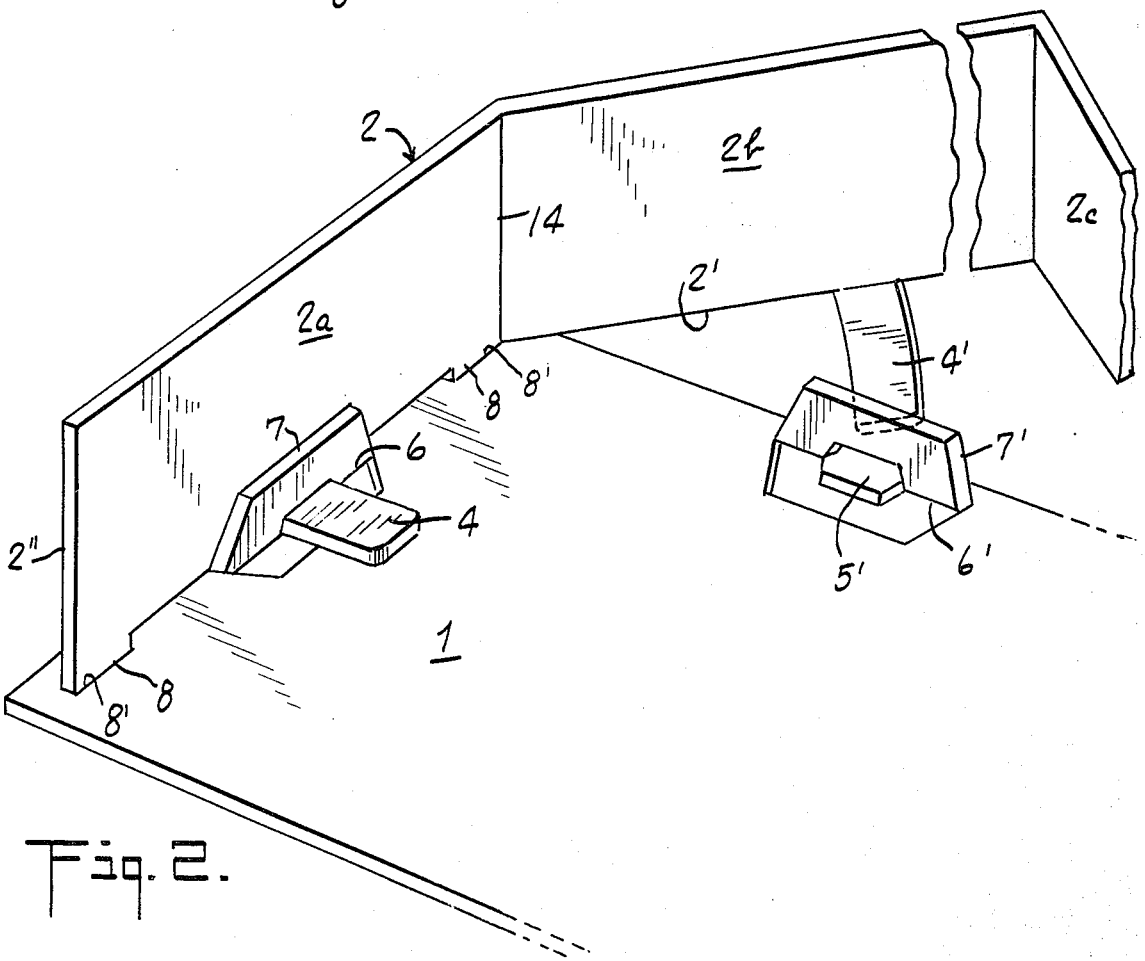
FIG. 2 is a perspective view as in FIG. 1 illustrating a further step in the assembly of the components.

The other component 2, which for convenience of description shall be referred to as the wall member, is provided with a tongue 4 and projections 8 on one of its edges 2'. The projections 8 are spaced from the tongue 4 a distance corresponding to the spacing of slots 8' from tab 7 so that there is mating cooperation between the projections 8 and slots 8' when the tongue 4 is inserted into slot 5 in the tab 7, as illustrated in FIG. 2. The length of the projections 8 preferably corresponds approximately to the thickness of the member 1.

The wall member 2 is a flat sheet which may be folded along weakened or scored lines on its surface to form a number of wall portions *2a, 2b, 2c,* etc. To minimize the number of different pieces in the construction set and yet permit versatility in the forms of the structures that may be built from the set, wall member 2 is preferably foldable into three wall portions. Accordingly, during assembly after tongue 4 is inserted in slot 5 and wall *2a* is moved upwardly folding tongue 4 within tab 7 to secure the wall member to the floor member, and the projections 8 are inserted in slots 8' to prevent tongue 4 from sliding out of slot 5, wall member 2 may be bent along the line 14 to form a wall portion 2*b*, as seen in FIG. 2. Another fold-up tab 7′ and slot 5′ are provided on the floor member 1 to cooperate with another tongue 4′ provided on the common lower edge 2′ of wall member 2. Tongue 4′ is preferably of an arcuate shape so as to facilitate its engagement in slot 5′ when wall 2*b* is pivoted through an arc about line 14 upon folding during assembly.

With walls 2*a* and 2*b* held in place on floor member 1 by the engagement of the described cooperating tabs, slots, tongues and projections, wall member 2 may again be folded or bent into one or more additional wall portions. These other wall portions may be variously provided with similar tongues and/or projections for respective cooperation with fold-up tabs and slots in the floor member 1 to secure the entire wall member 2 to floor member 1 and will particularly lock walls 2*a* and 2*b* in place. Various combinations may be used on any number of walls to form completed enclosures by abutting the last wall portion against the first wall portion 2*a* when the last wall portion is secured to the floor member 1, as will be apparent to those skilled in the art in view of the foregoing description. However, as previously mentioned, to permit versatility in the forms of the structures that may be built with the set, the first and last wall portions will preferably be spaced from each other when all the wall portions are secured to the floor member. In this instance, a further embodiment of the present invention is provided as will now be described in connection with FIGS. 3 and 4.

As seen in the figures, an extension in the form of a tab 9 is provided on the wall member 2 on one of the upright edges, such as the edge 2 of the first wall portion 2*a*. The extension tab 9 is sized so as to be capable of passing through a complementary slot formed in an abutting wall structure. The abutting wall structure may be the last wall portion 2*d* on wall member 2 in a closed wall configuration or a separate wall member 15 against which the wall portion containing the tongue extension tab 9 is to abut. Also, a connection can be made to more than one wall member by the combination of forming a number of complementary slots and extending the length of the extension tab 9. As seen in the figures, the last wall portion 2*d* of wall member 2 may be connected to the first wall portion 2*a* and a wall portion 2*e* of additional wall member 15 may be connected together by the provision of respective complementary slots 5″ and 5‴. To lock the abutting members together, a slot 10 is formed in the extension tab 9 and is spaced from edge 2′ a distance equal to the thickness of the one or more wall members to be joined, so that slot 10 is uncovered when all of the wall members are abutting. A separate locking tab 11 is provided having an extension 11*a* thereon, which is accommodated in slot 10 to lock the abutting walls together. A versatile corner joint is thus formed that neatly secures all of the wall components together. It will be seen that this wall-joining arrangement in combination with the previously described floor attaching arrangement provides a simple system for neatly and securely constructing two perpendicularly disposed structural components that may be used as wall and floor members as described or that may be differently oriented to form other structures as desired.

A further feature of the present invention involves an arrangement for securely connecting structural components arranged at an angle with each other, such as a roof member abutting the upper edge of a wall member. As seen in FIGS. 5 and 6, the upper edge ‴ of the wall member 2 is provided with a tongue extension 12 that may be marked with fold lines 12*a* and 12*b* respectively at its root and near its outer end. Parallel slots 13*a* and 13*b* are formed in the roof member 16 to accommodate the tongue extension 12. During assembly, the tongue extension 12 is passed through slot 13*a* until roof member 16 abuts the upper edge 2‴ of the wall member 2. Tongue extension 12 is then folded along lines 12*a* and 12*b* and its end inserted into slot 13*b* until its inner surface lies flat against the outer surface of the roof member 16. A neat and secure joining system is thus provided for members arranged at an angle that is simply assembled leaving no externally protruding tabs uncharacteristic of the actual structure after which the toy house is being modeled.

It will accordingly be seen by those skilled in the art that the present invention provides improved interlocking and connecting means of the tab/slot type, particularly suitable for use on components for the constructing of toy or model houses and similar structures, and creating neat and secure joints between the components while avoiding any external projections uncharacteristic of the structure being modeled. While the attaching and joining arrangements of the present invention have been particularly described in connection with components for constructing a simple house having a floor, walls and a roof, it will be within the purivew of those skilled in the art to utilize these arrangements in connection with various other structures with essentially unlimited versatility within the scope of the invention.

What is claimed is:

1. Construction set for a model house of the type having individual components of a thin foldable material such as sheets of cardboard provided with tabs and slots which in assembly are intended to interlock to hold the components together, comprising:

a first sheet member provided with at least two fold-up tabs, each having a slot arranged at its root, and at least one slot formed directly in said sheet member adjacent one of said fold-up tabs;

a second sheet member, the latter being foldable such that corners providing at least three walls can be formed therefrom upon folding;

tongue means, on the first wall and on at least one other of said three walls, extending from one of the two edges of said second sheet member which are common to said walls for respective engagement in said fold-up tab slots in said first sheet member;

a projection on the first of said three walls located on said one common edge thereof to one side of and spaced from said tongue means for engagement with said direct slot in said first sheet member, said tongue means in the assembled state of said sheet members being disposed in said fold-up tab slots and bent at right angles relative to said projection which is disposed in said direct slot holding the folded walls of said second sheet member substantially perpendicular to the first sheet member.

2. Construction set as in claim 1 wherein one of said three walls further comprises:

an extension tab on one edge of said one wall having a locking slot near the root thereof, said extension tab being engageable in a complementary slot in an abutting wall structure; and a locking tongue insertable into the locking slot after said comlementary slot and extension tab have been brought into mutual engagement to hold the extension tab in said complementary slot and lock said one wall in engagement with said abutting wall structure.

3. Construction set as in claim 2, wherein said extension tab has its locking slot disposed at a distance from the extension tab root corresponding to the thickness of the complementary slot through which it extends.

4. Construction set as in claim 1 wherein at least one of said three walls further comprises a tongue on the other common edge, said tongue having a foldable end and being foldable at its root for engagement in complementary parallel slots in an abutting wall structure.

5. Construction set as in claim 1 wherein one of said tongue means is on the second wall and is curved to facilitate its engagement in the cooperating fold-up tab slot when the first and second walls are folded during assembly.

6. Construction set as in claim 1 wherein said projection has a length corresponding approximately to the thickness of said first sheet member.

7. Construction set for a model of the type having individual components of a thin foldable material such as sheets of cardboard provided with tabs and slots which in assembly are intended to interlock to hold the components together, comprising:

a first sheet member provided with at least two fold-up tabs, each having a slot arranged at its root, and at least one slot formed directly in said sheet member adjacent one of said fold-up tabs;

a second sheet member, the latter being foldable such that a corner providing at least two walls can be formed therefrom upon folding;

two tongue means, extending from one of the two edges of said second sheet member which are common to said walls, for respective engagement in said fold-up tab slots in said first sheet member;

a projection on said one common edge adjacent one of said tongue means for engagement with said direct slot in said first sheet member, said tongue means in the assembled state of said sheet members being disposed in said fold-up tab slots and bent at right angles relative to said projection which is disposed in said direct slot holding the folded walls of said second sheet member substantially perpendicular to the first sheet member.

8. Construction set as in claim 7 wherein at least one of said two walls further comprises means for connecting said one of said two walls to an abutting wall structure.

9. Construction set as in claim 8 wherein said connecting means comprises:

an extension tab on one edge of said one of said two walls having a locking slot near the root thereof, said extension tab being engageable in a complementary slot in an abutting wall structure; and a locking tongue insertable into the locking slot after said complementary slot and extension tab have been brought into mutual engagement to hold the extension tab in said complementary slot and lock said one of said two walls in engagement with said abutting wall structure.

10. Construction set as in claim 7 wherein at least one of said two walls further comprises a tongue on the other common edge, said tongue having a foldable end and being foldable at its root for engagement in complementary parallel slots in an abutting wall structure.

11. Construction set as in claim 7 wherein one of said tongue means is curved to facilitate its engagement in the cooperating fold-up tab slot when the walls are folded during assembly.

12. Method of making a model house of the type constructed from individual components of a thin foldable material, such as sheets of cardboard, provided with tabs and slots which in assembly are intended to interlock to hold the components together, comprising the steps of:

forming a first sheet member of said material with at least two fold-up tabs, each having a slot therethrough at its root, and with at least one slot in the sheet member adjacent one of said fold-up tabs;

forming a second sheet member of said material so as to be foldable to form corners providing three wall portions with tongues on one of the two edges of the sheet member common to said wall portions, at least one of which tongues extends from the first wall portion and at least one other of which tongues extends from another of said three wall portions, and with a projection on said one edge of said first wall portion to one side of and spaced from said one tongue;

inserting said one tongue on the first wall portion into the fold-up tab slot adjacent said one slot in the first sheet member and then inserting said projection into said one slot, such that said one tongue is bent at a right angle relative to said projection; then folding said second sheet member to form said three wall portions, and folding and inserting said other tongue into the other fold-up tab slot to hold the folded wall portion substantially perpendicular to said first sheet member.

13. Method as in claim 8 wherein said other tongue is curved to facilitate its engagement in the cooperating other fold-up slot when the first and second wall portions of said second sheet member are folded during assembly.

14. Method as in claim 8 comprising the further steps of:

forming an extension tab on one edge of one of said three wall portions with a locking slot near the root of said extension tab;

forming a comlementary slot in an abutting wall structure for receiving said tongue extension tab therethrough; and forming a locking tongue and inserting it into said locking slot after said complementary slot and extension tab have been brought into mutual engagement to hold the extension tab in said complementary slot and lock said one wall portion in engagement with said abutting wall structure.

15. Method as in claim 14 wherein said locking slot is formed at a distance from said extension tab root corresponding to the thickness of said complementary slot.

16. Method as in claim 12 comprising the further steps of:

forming another tongue on at least one of said three wall portions on the other common edge of said second sheet member;

forming parallel slots in an abutting wall structure; and folding said another tongue at its root and at its end for respective engagement in said parallel slots to hold said one wall portion in engagement with said abutting wall structure.

17. Method of making a model of the type constructed from individual components of a thin foldable material, such as sheets of cardboard, provided with tabs and slots which in assembly are intended to interlock to hold the components together, comprising the steps of:

forming a first sheet member of said material with at least two fold-up tabs, each having a slot therethrough at its root, and with at least one slot in the sheet member adjacent one of said fold-up tabs;

forming a second sheet member of said material so as to be foldable to form at least one corner providing two wall portions with at least two tongues on one of the two edges of the sheet member common to said wall portions, and with a projection on said one edge of said wall portions adjacent to one of said tongues;

folding said second sheet member to form said two wall portions;

inserting said one tongue into the fold-up tab slot adjacent said one slot in the first sheet member and inserting said projection into said one slot, such that said one tongue is bent at a right angle relative to said projection; and folding and inserting said other tongue into the other fold-up tab slot to hold said two folded wall portions of said second sheet member substantially perpendicular to said first sheet member.

18. Method as in claim 17 wherein one of said tongues is curved to facilitate its engagement in the cooperating fold-up tab slot when the wall portions of said second sheet member are folded during assembly.

19. Method as in claim 17 comprising the further steps of:

forming an extension tab on one edge of one of said two wall portions with a locking slot near the root of said extension tab;

forming a complementary slot in an abutting wall structure for receiving said tongue extension tab therethrough; and forming a locking tongue and inserting it into said locking slot after said complementary slot and extension tab have been brought into mutual engagement to hold the extension tab in said complementary slot and lock said one wall portion in engagement with said abutting wall structure.

20. Method as in claim 17 comprising the further steps of:

forming another tongue on at least one of said two wall portions on the other common edge of said second sheet member;

forming parallel slots in an abutting wall structure; and folding said another tongue at its root and at its end for respective engagement in said parallel slots to hold said one wall portion in engagement with said abutting wall structure.

* * * * *